US010226094B2

(12) United States Patent
Straus et al.

(10) Patent No.: US 10,226,094 B2
(45) Date of Patent: Mar. 12, 2019

(54) HELMET FOR TANGENTIAL AND DIRECT IMPACTS

(71) Applicant: AES R&D, LLC, Timonium, MD (US)

(72) Inventors: Albert Straus, Timonium, MD (US); Robert J. Michael, Waterford, PA (US)

(73) Assignee: AES R&D, LLC, Timonium, MD (US)

( * ) Notice: Subject to any disclaimer, the term of this patent is extended or adjusted under 35 U.S.C. 154(b) by 0 days.

(21) Appl. No.: 15/822,545

(22) Filed: Nov. 27, 2017

(65) Prior Publication Data

US 2018/0077990 A1 Mar. 22, 2018

Related U.S. Application Data

(63) Continuation-in-part of application No. 15/009,960, filed on Jan. 29, 2016.

(51) Int. Cl.

| | |
|---|---|
| ***A42B 3/00*** | (2006.01) |
| ***A42B 3/06*** | (2006.01) |
| ***A63B 71/10*** | (2006.01) |
| *A42B 3/28* | (2006.01) |

(52) U.S. Cl.

CPC ..... *A42B 3/064* (2013.01); *A63B 71/10* (2013.01); *A42B 3/283* (2013.01)

(58) Field of Classification Search

CPC ..... A42B 3/324; A42B 3/064; A42B 3/283; A63B 71/10

USPC ..... 2/422, 412

See application file for complete search history.

(56) References Cited

U.S. PATENT DOCUMENTS

| | | | |
|---|---|---|---|
| 2,143,483 | A | 1/1939 | Iglauer |
| 2,296,335 | A | 9/1942 | Brady |
| 2,780,815 | A | 2/1957 | Newland |
| 3,128,095 | A | 4/1964 | Sharkey |
| 3,155,981 | A | 11/1964 | McKissick et al. |

(Continued)

FOREIGN PATENT DOCUMENTS

| | | |
|---|---|---|
| DE | 2941019 | 4/1981 |
| FR | 1374284 | 10/1964 |

(Continued)

OTHER PUBLICATIONS

Sport techie website, Dated Dec. 2, 2015 "Building a Safer Helmet for Youth Football" http://www.sporttechie.com/2015/12/02/football-helmet-specifically-designed-protection-young-athletes/.

(Continued)

*Primary Examiner* — Timothy K Trieu

(74) *Attorney, Agent, or Firm* — Kenneth C. Spafford

(57) ABSTRACT

Apparatus for protecting a user from impacts to the head. The apparatus includes a shell configured to receive a human head and a plurality of structures attached to the outer surface of the shell. Each structure includes an outer cell that absorbs direct impacts. Each structure is independently coupled to the shell with a respective assembly. The structures move independently of one another and are restricted to sliding tangentially along the outer surface of the shell. The assemblies each include a biasing mechanism that absorbs tangential impacts to the structure and returns the respective structure to its rest position. Thus, a user is protected from the concussive effects of a head-on impact and the rotational acceleration injuries of a tangential impact.

14 Claims, 16 Drawing Sheets

(56) References Cited

U.S. PATENT DOCUMENTS

| | | | | |
|---|---|---|---|---|
| 3,174,555 | A | 3/1965 | Pitman | |
| 3,186,004 | A | 6/1965 | Carlini | |
| 3,242,500 | A | 3/1966 | Derr | |
| 3,245,087 | A | 4/1966 | Marchello | |
| 3,435,460 | A | 4/1969 | Grant | |
| 3,445,860 | A | 5/1969 | Rodell | |
| 3,787,893 | A | 1/1974 | Larcher | |
| 3,815,152 | A | 6/1974 | Bednarczuk et al. | |
| 3,818,508 | A | 6/1974 | Lammers et al. | |
| 3,859,666 | A | 1/1975 | Marietta et al. | |
| 3,992,722 | A | 11/1976 | Rhee | |
| 4,044,399 | A | 8/1977 | Morton | |
| 4,106,124 | A | 8/1978 | Green | |
| 4,223,409 | A | 9/1980 | Lee | |
| 4,307,471 | A | 12/1981 | Lovell | |
| 4,599,752 | A | 7/1986 | Mitchell | |
| 4,660,230 | A | 4/1987 | Mayling | |
| 4,692,947 | A | 9/1987 | Black et al. | |
| 4,744,107 | A | 5/1988 | Fohl | |
| 4,937,888 | A | 7/1990 | Straus | |
| 4,996,724 | A | 3/1991 | Dextrase | |
| 5,010,598 | A | 4/1991 | Flynn et al. | |
| 5,204,998 | A | 4/1993 | Liu | |
| 5,343,569 | A | 9/1994 | Asare et al. | |
| 5,477,565 | A | 12/1995 | Hunt, Jr. | |
| 5,519,895 | A | 5/1996 | Barnes, Jr. | |
| 5,522,091 | A | 6/1996 | Rudolf | |
| 5,633,286 | A | 5/1997 | Chen | |
| 5,724,681 | A | 3/1998 | Sykes | |
| 5,950,244 | A | 9/1999 | Founier et al. | |
| 5,956,777 | A | 9/1999 | Popovich | |
| 6,065,158 | A | 5/2000 | Rush, III | |
| 6,154,889 | A | 12/2000 | Moore, III et al. | |
| 6,226,801 | B1 | 5/2001 | Alexander et al. | |
| 6,272,692 | B1 * | 8/2001 | Abraham | A42B 3/063 2/411 |
| 6,292,954 | B1 | 9/2001 | O'Bradaigh et al. | |
| 6,336,220 | B1 | 1/2002 | Sacks et al. | |
| 6,421,840 | B1 | 7/2002 | Chen et al. | |
| 7,089,602 | B2 | 8/2006 | Talluri | |
| 7,096,512 | B2 | 8/2006 | Blair | |
| 7,328,462 | B1 | 2/2008 | Straus | |
| 7,930,771 | B2 | 4/2011 | Depreitere et al. | |
| 8,756,719 | B2 * | 6/2014 | Veazie | A42B 3/121 2/411 |
| 8,776,272 | B1 | 7/2014 | Straus et al. | |
| 8,826,468 | B2 | 9/2014 | Harris | |
| 8,927,088 | B2 | 1/2015 | Faden et al. | |
| 8,955,169 | B2 | 2/2015 | Weber | |
| 9,032,558 | B2 | 5/2015 | Leon | |
| 9,060,561 | B2 | 6/2015 | Knight | |
| 9,072,330 | B2 | 7/2015 | Yoon | |
| 9,089,180 | B2 | 7/2015 | Phipps | |
| 2002/0152541 | A1 | 10/2002 | Halstead et al. | |
| 2012/0017358 | A1 | 1/2012 | Princip et al. | |
| 2013/0019385 | A1 | 1/2013 | Knight | |
| 2013/0031700 | A1 | 2/2013 | Wacter et al. | |
| 2013/0247284 | A1 | 9/2013 | Hoshizaki et al. | |
| 2013/0254978 | A1 | 10/2013 | McInnis et al. | |
| 2014/0000012 | A1 | 1/2014 | Mustapha | |
| 2014/0013492 | A1 | 1/2014 | Bottlang et al. | |
| 2014/0068841 | A1 | 3/2014 | Brown | |
| 2014/0075652 | A1 | 3/2014 | Hanson et al. | |
| 2014/0109298 | A1 | 4/2014 | Faden et al. | |
| 2014/0173810 | A1 | 6/2014 | Suddaby | |
| 2014/0208486 | A1 | 7/2014 | Krueger | |
| 2014/0215694 | A1 * | 8/2014 | Grice | A42B 3/06 2/411 |
| 2015/0033453 | A1 | 2/2015 | Pannikottu et al. | |
| 2015/0135413 | A1 | 5/2015 | Mayerovitch | |
| 2015/0164173 | A1 | 6/2015 | West | |
| 2015/0223547 | A1 | 8/2015 | Wibby | |
| 2015/0237946 | A1 | 8/2015 | Simpson | |
| 2017/0215507 | A1 | 8/2017 | Straus | |

FOREIGN PATENT DOCUMENTS

| | | |
|---|---|---|
| FR | 2566632 | 1/1986 |
| WO | WO2011121079 | 10/2011 |

OTHER PUBLICATIONS

Matthew Futterman, "Rethinking the Next Generation Helmet" Wall Street Journal Website Dated Dec. 24, 2015 http://www.wsj.com/articles/rethinking-the-next-generation-helmet-1450998090, written by Matthew Futterman.

Bryan Gruley and Peter Robison, "This Football Helmet Crumples—and That's Good" Bloomberg Business, Dated Jan. 11, 2016 http://www.bloomberg.com/features/2016-vicis-football-helmet/.

Office Action, Non-Final, dated Apr. 5, 2017, Paper No. 20170330, 34 pages.

Office Action, Final, dated Aug. 10, 2017, Paper No. 20170727, 24 pages.

* cited by examiner

HELMET FOR TANGENTIAL AND DIRECT IMPACTS

CROSS-REFERENCE TO RELATED APPLICATIONS

This application is a continuation-in-part of patent application Ser. No. 15/009,960, filed Jan. 29, 2016.

STATEMENT REGARDING FEDERALLY SPONSORED RESEARCH OR DEVELOPMENT

Not Applicable

BACKGROUND

1. Field of Invention

This invention pertains to protective headgear. More particularly, this invention pertains to helmets that protect against injuries from direct and tangential impacts to the head.

2. Description of the Related Art

Concussions are a common problem in American football and other contact sports. Repetitive impact to the head can lead to very serious and long term injuries and related issues. Therefore, it is important that measures be taken to protect athletes, to reduce their risks.

Various types of sports helmets are used to reduce brain injuries, including skull and neck injuries, resulting from head impacts. Such helmets typically employ a hard outer shell in combination with internal padding made of an energy-absorbing material. A conventional helmet is generally designed to prevent skull fracture, and, to some extent, injuries associated with linear acceleration following a direct impact. Bio-mechanical research has long understood, however, that angular forces from a tangential impact can cause serious brain damage, including concussion, axonal injury, and hemorrhages. Neurological research studies show that angular or rotational forces can strain nerve cells and axons more than linear forces. It is thus desirable to have protective headgear that protects against both direct impacts and tangential impacts that cause rotational injuries.

BRIEF SUMMARY

According to one embodiment of the present invention, an helmet for protecting a user from an impact is provided. The helmet includes a shell configured to receive a human head. The helmet includes a plurality of structures coupled to the outside of the shell. Each structure is attached to a respective assembly, which in turn is recessed in a respective opening in the shell. Each structure moves independently of the other structures. The structures are capable of sliding tangentially across the outer surface of the shell. The respective assemblies are individually detachable from the shell.

Each assembly includes a biasing mechanism. The biasing mechanism absorbs the impact of a tangential impact to its respective structure. After an impact, the biasing mechanism biases the corresponding structure to slide back to its original rest position. In one embodiment, the biasing mechanism is an elastomeric donut.

Each assembly is mechanically detachable from and reattachable to the shell. Thus, a user is able to swap out an assembly donut for a donut with different elastomeric properties.

Each structure includes an outer cell. The outer cell is resilient. In one embodiment, the cell is made of foam. The cell is capable of deforming upon being impacted. The cell biases to return to its original shape after impact.

According to one embodiment of the present invention, a protective helmet is provided. The helmet includes a shell configured to receive a human head. A plurality of structures are independently coupled to the shell and are directly adjacent to the outer surface of the shell. Each structure moves independently of the other structures but is restricted to move laterally along the outer surface to the shell. When a structure is hit with an impact, the impact's magnitude is reduced as the impact is transferred from the structure to the shell.

In one embodiment, each structure can be independently replaced by manually detaching it from the shell. In one embodiment, each structure includes a cell made of foam with a specific resiliency, where an optimal resiliency is based upon field impact testing for a particular player position. In one embodiment, each structure includes both a back plate adjacent to the shell and a cell, where the back plates are farther away from each other than the cells. The cells have adjacent perimeters that are beveled at supplemental angles to one another.

In one embodiment, each structure is coupled to a respective assembly that in turn is coupled to the helmet shell. Each assembly includes an elastomeric donut whose top surface is coplanar with the outer surface of the shell. Each donut is capable of compressing and extending when its corresponding structure experiences a lateral impact. The compressing and extending of the donut extends the time of impact transfer from the structure to the shell, thereby reducing the magnitude of an impact transfer from lateral hit. In one embodiment, each assembly also includes a rectangular receiver configured to receive one or more vertical portions of a respective back plate.

In one embodiment, the donuts are elliptical and reduce the magnitude of a lateral impact a maximum amount when the impact is directly perpendicular to the donut's major axis. In one embodiment, there are vents directly between adjacent structures, thereby allowing greater freedom of lateral movement for each structure.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus 100 for protecting a user from lateral and direct impacts to the head is disclosed. Various elements are described generically below and are uniquely identified when pertinent to the discussion, for example, structures 120 are generally indicated as 120 with particular embodiments and variations shown in the figures below having a suffix, for example, 120-A, 120-B, 120-C.

Figure 1:
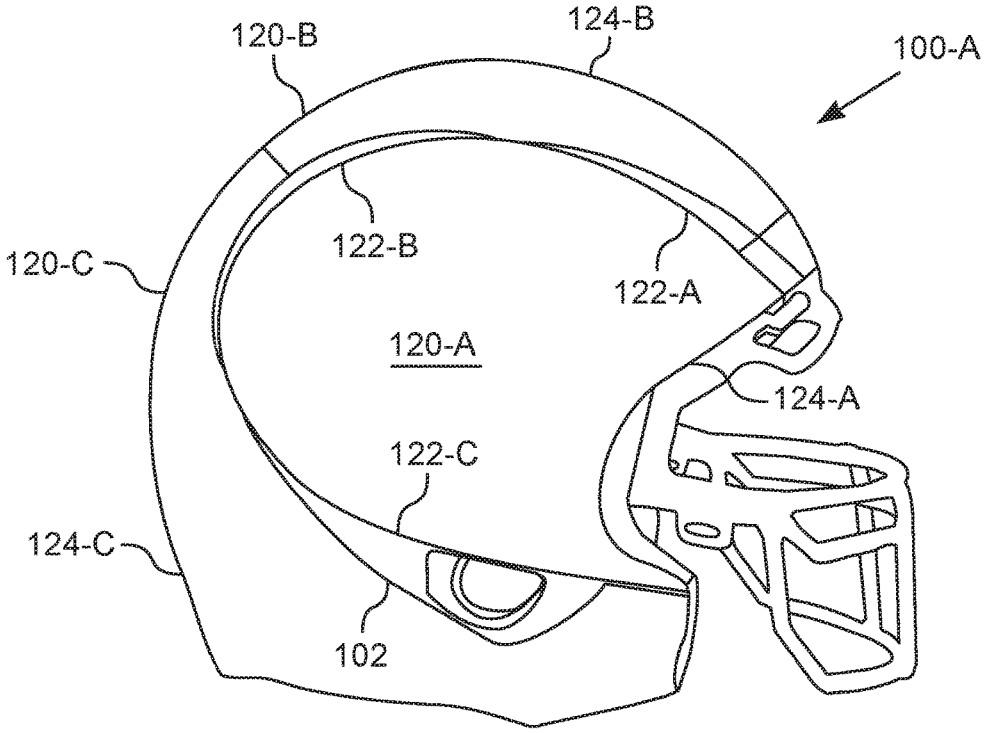
FIG. 1 is a side view of a first embodiment of a protective helmet.

FIG. 1 illustrates a perspective view of one embodiment of the protective helmet 100-A. The helmet 100-A includes a frame 102 configured to fit a human head. The helmet 100-A also includes a plurality of structures 120 that are independently attached to the outside of the frame 102, including a side structure 120-A, a top structure 102-B, and a rear structure 120-C. Each structure 120 is attached to frame 102 in a manner that permits only lateral, i.e., rotational, movement of that structure 120 along and around the frame 102. Each structure 120 is configured to move independently of the other structures 120. The external portion of each structure 120-A, 120-B, 120-C includes a respective cell 124-A, 124-B, 124-C. Cells 124 are made from a reaction-molded polyurethane flexible foam.

A lateral impact upon a structure 120 will cause the structure 120 to rotate laterally relative to the frame 102-A and increase the duration of the lateral impact event. Thus, the structures 120 protect a user from the concussive effects of a lateral impact targeted at the user's head.

An impact perpendicular to the helmet 100, i.e., a direct impact upon a structure 120, will compress its respective cell 124 and increase the duration of the direct impact event. Thus, the cells 124 protect a user from concussive effects of a direct impact targeted at the user's head.

Figure 2:
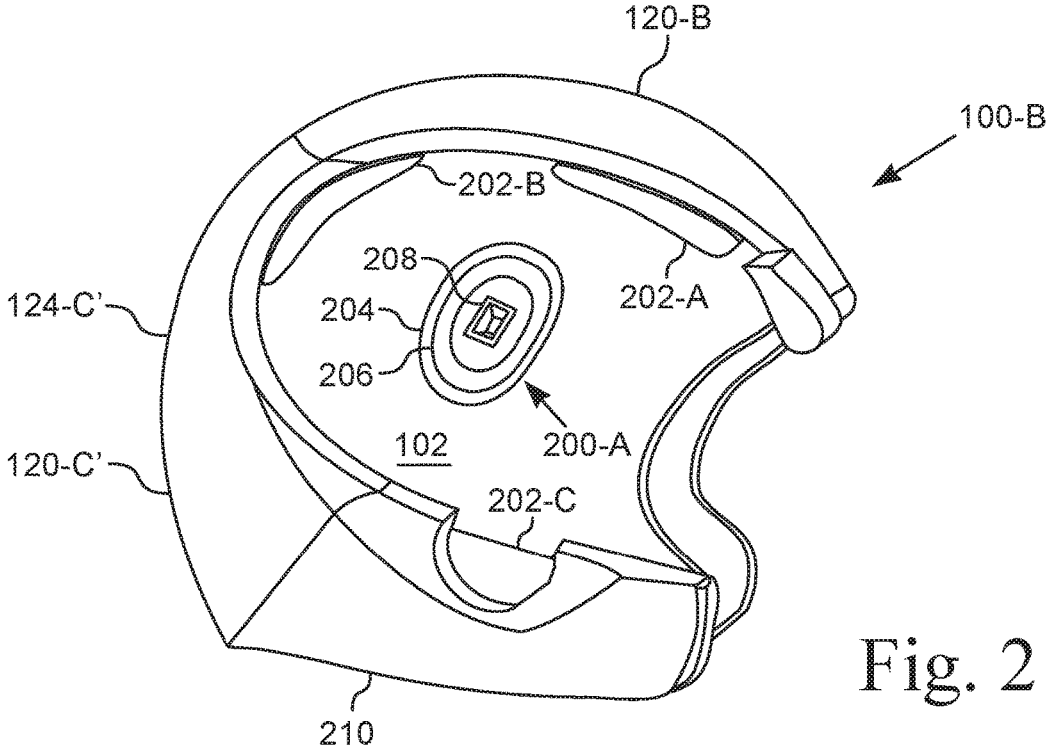
FIG. 2 is a side view of a second embodiment of a protective helmet, with one structure removed to display the helmet frame and an assembly underneath.

In other embodiments, cells 124 have a different cell density and compression force than the cells shown in FIGS. 1 and 2. The optimal cell density and compression force depends on factors including the likelihood of area of impact on a particular player. For example, a lineman may require more protection from frontal impacts and therefore top cell 124-B will require durometer adjustment after field testing. On the other hand, a quarterback may require more protection in the occipital region, and side and rear cells 124-A, 124-C will require durometer adjustment after field testing.

In this embodiment, vents 122-A, 122-B, 122-C allow for air flow to the user's head through air holes 202-A, 202-B, 202-C. Vents 122 also create spacing between structures 120 which allows structures 120 to rotate laterally along helmet without contacting other structures 120.

In other embodiments, vents 122 are in other arrangements, which are designed to create maximum spacing and minimal contact between the structures 120 during lateral movement of a structure 120. The likely direction of a structure's 120 lateral movement is based upon the likely impact vector on the helmet 100. The likely impact vector on the helmet is in turn is based upon, for example, a football player's position on a team. Thus, in other embodiments arrangements of the vents 122 and structures 120 are based upon a football player's position on the team.

In another embodiment, there are no visible vents and structures 120 completely cover the outer surface of frame 102.

FIG. 2 illustrates a helmet embodiment 100-B where portion 210 that is fixed to the outside of the frame 102 does not move relative to the frame 102. Rear structure 120-C' does not continue to the front of helmet 100-B.

In FIG. 2 structure 120-A is removed for the purpose of displaying respective assembly 200-A to which structure 120-A is affixed. Assembly 200-A includes an elastomeric donut 204 that is integral with frame 102. Assembly also includes donut hole 602 with a receiver 208 inside for receiving structure 120-A. Receiver 208 and structure 120-A are in a fixed position relative to one another. Upon a lateral impact on structure 120-A, the donut 204 deforms in a lateral direction, allowing structure 120-A and receiver 208 to move independently of frame 102 and increase the duration of the lateral impact event.

The major axis of donut 204 shown in FIG. 2 runs vertically along frame 102. A lateral impact event will be the longest where the impact vector is centered on the donut 204 and aligned along the donut 204 minor axis. Thus, the longitude of donut 204 runs perpendicular to the anticipated major vector direction of the impact. Therefore, the alignment and positioning of the donut depends upon the user's position on a team and from what lateral direction the user is most likely to experience an impact to the head. Therefore, in another embodiment, the major axis of donut 204 is aligned in another direction. In another embodiment, the donut 102 is a circle.

Figure 3:
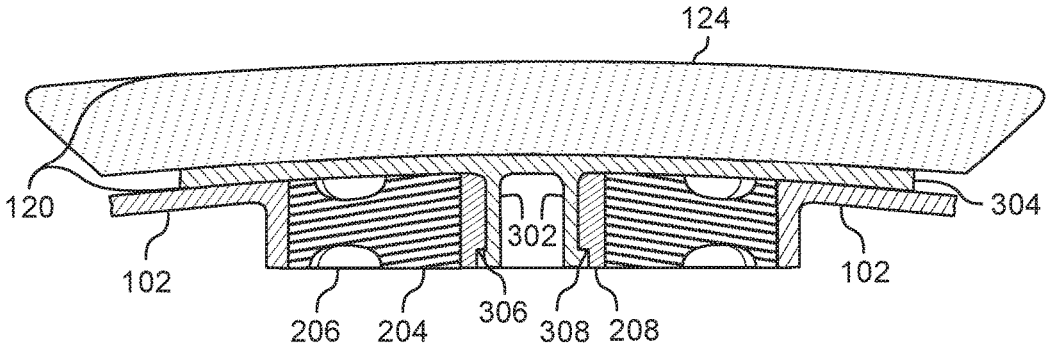
FIG. 3 is a side cross-section view of one structure and corresponding assembly of the first embodiment of FIG. 1.

FIG. 3 illustrates a cross section view of a structure 120 attached to an assembly 200, cut along the major axis 500 of donut 204. Structure 120 includes backplate 304 which is integral with cell 124. Backplate 304 includes a perpendicular section 302 configured to fit into receiver 208. Receiver 208 is rectangular in shape for precision orientation of cell 124. The perpendicular section 302 ends in barbs 308. Receiver 208 includes undercuts 306 to capture the locking edges of barbs 308. In other embodiments, the attachment mechanism between structure 120 and assembly 200 are a plurality of snap fasteners, a set of hook and loop fasteners, a tongue-in-groove pairing, a bolt and nut system, or other attachment means well-known to those with ordinary skill in the art.

Backplate 304 is contiguous with frame 102. Outer surface 310 of frame 102 is coplanar with, and shares a common tangent with, top surface 312 of donut 204 where frame outer surface 310 and donut top surface 312 are in contact. Both backplate 304 and frame 102 are made from injected-molded thermoplastic. In other embodiments, they are made from composite structures. The backplate 304 and frame 102 have a low friction modulus which allows backplate 304 and overall structure 120 to slide laterally relative to frame 102 during a lateral impact event. The low friction between backplate 304 and frame 102 allows the distortion of donut 204 to be the primary mechanism for managing the energy from the lateral impact.

However, receiver 208 and backplate 304 are locked and therefore structure 120 can only move laterally and not inward or outward, i.e., not move radially, relative to helmet frame 102.

Backplate 304 does not extend laterally as far as cell 124 in order to prevent backplate 304 from colliding into other backplates 304 during a lateral impact event. Spacing between backplates 304 allows some cell 124 deflection along the cells' perimeters when one cell 124 moves laterally into contact with another cell 124.

Donut 204 includes hollowed out volumes 206 that increases the ability of the donut 204 to extend or compress during a lateral impact event, thereby amplifying the possible lateral movement of structure 120. The configuration of these hollowed out volumes 206 can be modified to respond to a particular threat analysis where greater or lesser impact delay is required.

Figure 4:
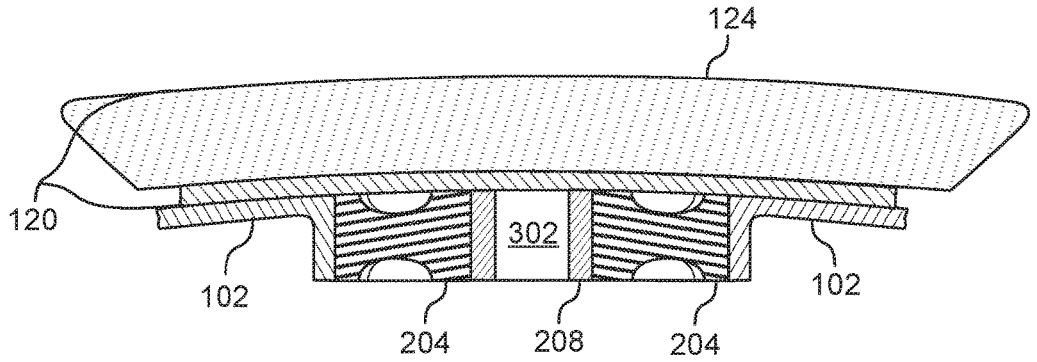
FIG. 4 is a second side-cross section view of the structure and corresponding assembly of FIG. 3, horizontally perpendicular to the cross-section view of FIG. 3.

FIG. 4 illustrates a cross section view of structure 120 attached to assembly 200, cut along the minor axis 502 of donut 204. A lateral impact event along the minor axis 502, e.g., horizontally across the structure 120 oriented in FIG. 4, creates the maximum increase in duration of the lateral impact event. Also, from the perspective orientation of FIG. 4, the vertical portions 302 of backplate 304 are perpendicular to viewable walls of receiver 208. Thus, vertical portion 302 and barbs 308 are oriented to withstand the major impact vector, i.e., they are less susceptible to bending during a lateral impact horizontal to the cell 124 in FIG. 4.

Figure 5:
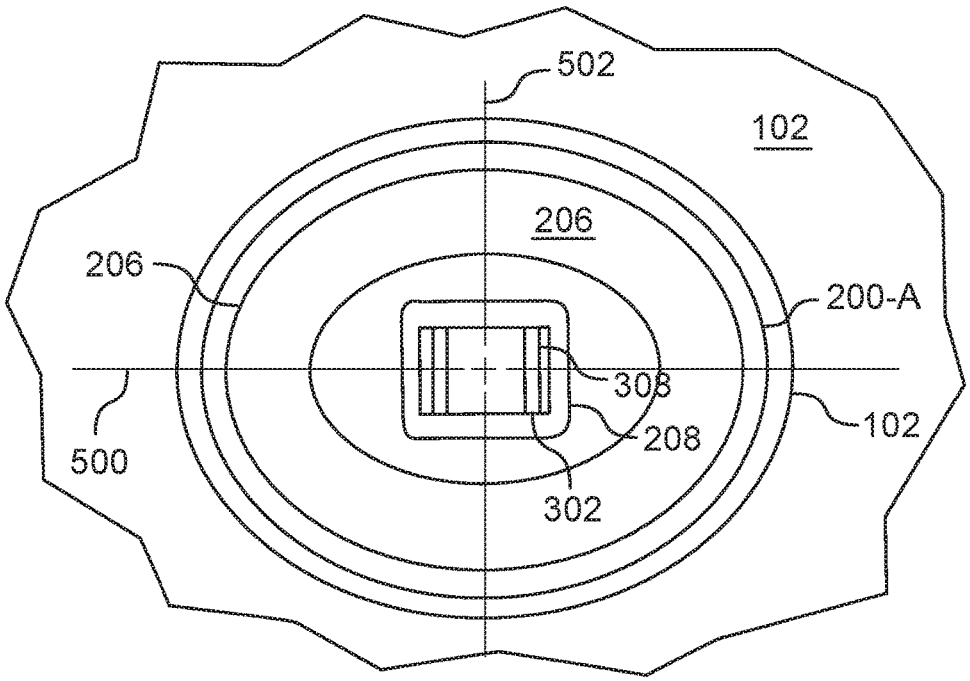
FIG. 5 is an inside view of the structure and corresponding assembly of FIGS. 3 and 4.
Figure 6:
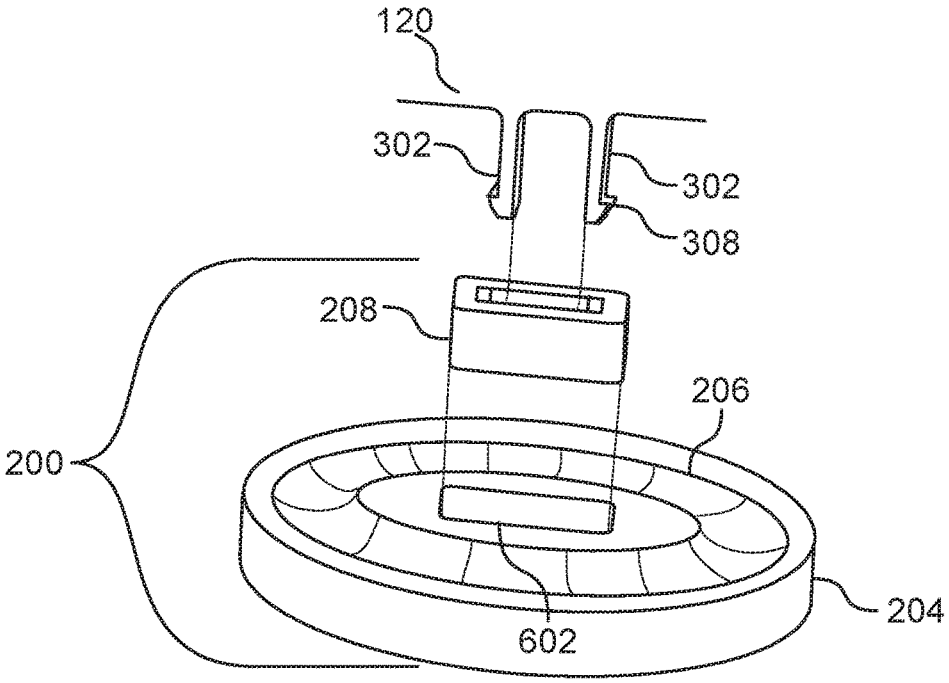
FIG. 6 is an exploded view of the structure and corresponding assembly of FIGS. 3-5.

FIG. 5 illustrates a view from inside the frame 102 of an assembly 200 attached to frame 102. FIG. 6 illustrates and exploded view of assembly 200 and the connector parts of the assembly 200 and structure 120 connector, i.e., hooks 308 and receiver 208.

FIG. 6 illustrates an exploded view displaying the assembly 200 components, namely the elastomeric donut 204 and receiver 208. Receiver 208 is inserted into hole 602 and chemically bonded to donut 204. Structure 120 can be removed from assembly 200 by pressing in barbs 308 and lifting structure 120 away from assembly 120. Thus, a user can easily replace a cell 124 that is damaged, or swap out a cell 124 for one that has different desired properties, for example higher or lower on the durometer scale.

Figure 7:
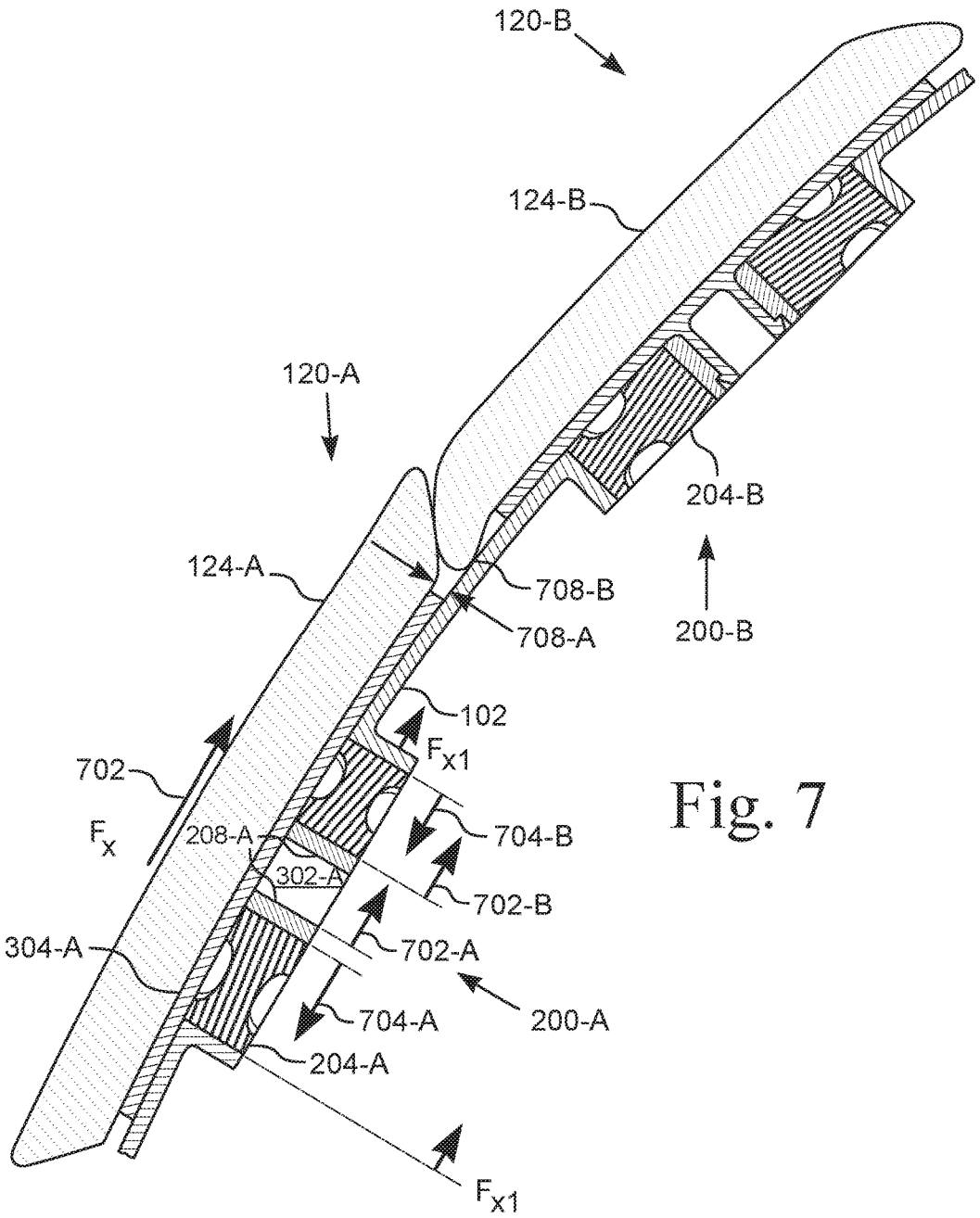
FIG. 7 is a side cross-section view of two structures and corresponding assemblies of the first embodiment of FIG. 1, where one structure is receiving a lateral impact.

FIG. 7 illustrates a rightward lateral impact event 702 on a cell 124-A. Cell 124-A, back plate 304-A, back plate vertical portion 302-A, and receiver 208-A are affixed together and move rightward laterally as one unit. Thus, lateral impact force F. 702 on the surface of cell 124-A drives receiver 208-A rightward in a clockwise direction with the same impact force 702-A and 702-B. However, impact force vector 702 does not immediately transfer to helmet frame 102, because frame 102 and receiver 208-A are coupled by elastomeric donut 204-A. Instead, the impact force 702 is spread out over time, as impact force subpart 702-A extends a portion of donut 204-A and impact force subpart 702-B compresses the opposite side of donut 204-A which in turn distributes the impact force 702 to frame vertical portion 208-A over an extended period of time, resulting in vector $F_{x1}$. After the impact event, the elastomeric property of donut 204-A pulls receiver 208-A and structure 120-A back to their original resting position with forces 704-A, 704-B.

Donut opposing forces 704-A and 704-B from donut 204-A and frame 102 pushing back on impact force 702 are in line with impact forces 702-A and 702-B. Thus, any shearing effect on donut 204-A is minimal, in contrast with a helmet that positions donut 204 or another type of damper/shock absorber/impact delay device directly between frame 102 and structure 120.

Cell 124-A has beveled edges supplementary to the beveled edges of adjacent cell 124-B, allowing the two adjacent cells 124-A, 124-B to move independently with minimal interference from one another. In FIG. 7, cell 124-A is temporarily rotated clockwise rightward in FIG. 7 from lateral impact 702. When cell 124-A shifts from the impact, cell 124-A experiences a slight distortion upward at 708-A where cell 124-A presses against and slides over adjacent cell 124-B. Note that cell 124-A and back plate 304-A are chemically bonded and integral and therefore do not separate. Adjacent cell 124-B experiences a downward distortion at 708-B to accommodate for rightward movement of adjacent cell 124-A. In other impact scenarios, the impacted cell experiences a downward distortion and an adjacent cell experiences and upward distortion, depending on relative cell edge relationship. Thus cell 124-A is able to move laterally relative to adjacent cell 124-B with minimal interference, and with minimal effect on structure 120-B. Cell 124-B and donut 204-B experience minimal impact distortion.

Figure 8:
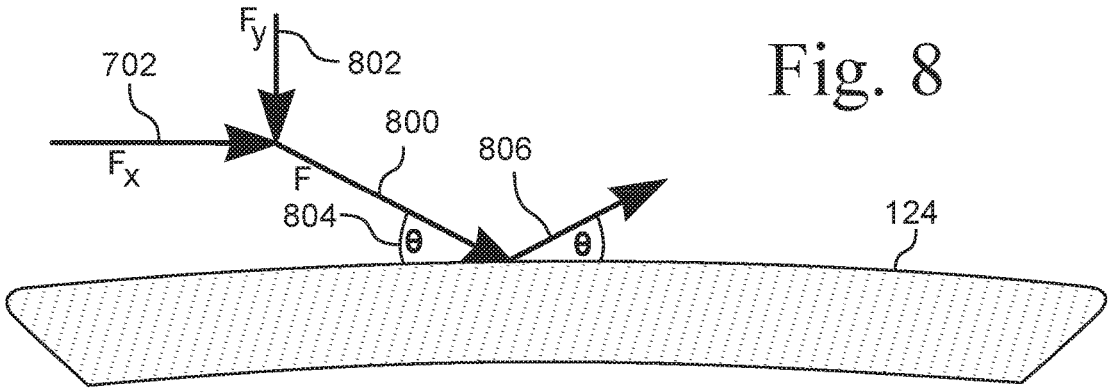
FIG. 8 is a simplified view of the structure displayed in FIG. 3.

As illustrated in FIG. 8, an impact event 800 will ordinarily occur at an angle 804 that includes lateral and direct component vectors 702, 802. The helmet 100 protects a user from the harmful effects of the impact event 800 by spreading the impact event components 702, 802 out over time. The lateral component 702 is spread out over time with the assistance of the donut assembly 204, while the direct component 802 is spread out over time with the assistance of the flexible foam cell 124.

Because of the energy-absorbing capacity of the helmet structure, impact restitution vector 806 is reduced. The diminished restitution reduces the impact on players that contact the wearer's helmet. Other players are thereby protected.

Figure 9:
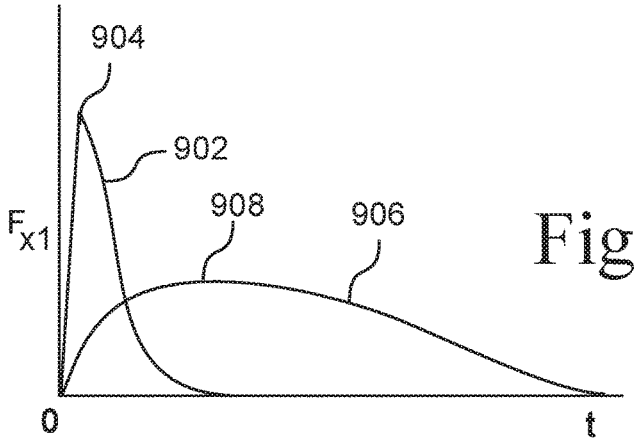
FIG. 9 is a graph displaying force over time from a lateral impact.

FIG. 9 is a line graph comparing the vector $F_{x1}$ from an impact transferred to a helmet frame 102 that is either unprotected or protected by a donut assembly 200. Line 902 represents the change of force over time dF/dt during a lateral impact event 702 on the frame of an ordinary unprotected helmet. The lateral force $F_x$ is transferred almost immediately to the frame 102, resulting in a large maximum impact 904 on the user and rotational acceleration. Line 906, on the other hand, represents the change of force over time dF/dt for embodiments of the protective helmet 100. Line 906 describes the vector $F_{x1}$ to the frame 102 as the lateral impact event 702 is transferred from the cell 124 and structure 120 to the donut 200. The donut 200 then extends/compresses while transferring the force $F_{x1}$ to the frame. Thus, a portion of the force $F_x$ is initially used to distorting the donut 200 before the force $F_{x1}$ is transferred to the frame. As a result, the force 906 on the protected helmet is spread out over time, resulting in a lower maximum impact 908 on the frame 102 and lower rotational acceleration. Thus, even though the total lateral impulse (i.e., the areas under 902 or 906) transferred upon a user is identical for a protected helmet 100 and an unprotected helmet, the maximum force 908 transferred upon a user is much less for the protective helmet 100. As a result, the maximum rotational acceleration of the user's head is reduced.

Figure 10:
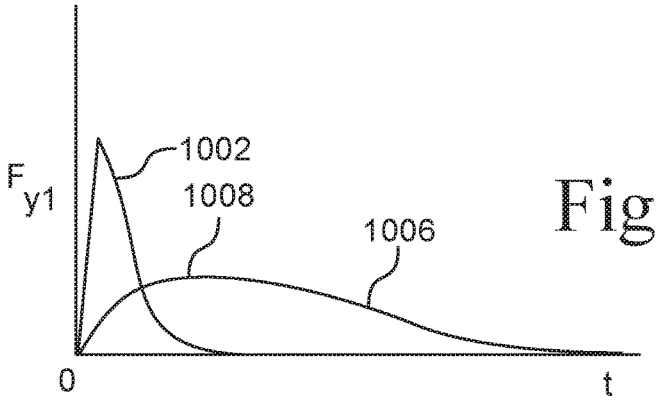
FIG. 10 is a second graph displaying force over time from a direct impact.

FIG. 10 is a line graph comparing the vector $F_{y1}$ from a direct force transferred to a helmet frame 102 that is either unprotected or protected by a cell 124. Line 1002 represents the change of force over time dF/dt during a direct impact event 802 on the frame of an ordinary unprotected helmet. The lateral force $F_y$ is transferred almost immediately to the frame 102, resulting in a large maximum impact 1004 on the user. Line 1006, on the other hand, represents the change of force over time dF/dt for embodiments of the protective helmet 100. Line 1006 describes the vector $F_{y1}$ to the frame 102 as the lateral impact event 802 is transferred onto the cell 124. Cell 124 is made of a flexible foam that will compress upon impact. Thus, cell 124 compresses while transferring the force $F_{y1}$ to the frame. Thus, a portion of the force $F_y$ is initially used to distort the cell 124 before the force $F_{y1}$ is transferred to the frame. As a result, the force 1006 on the protected helmet is spread out over time, resulting in a lower maximum impact 1008 on the frame 102. Thus, even though the total direct impulse (i.e., the areas under 1002 or 1006) transferred upon a user is identical for a protected helmet 100 and an unprotected helmet, the maximum force 1008 transferred upon a user is much less for the protective helmet 100 that is covered by cells 124.

The apparatus includes various functions.

The function of spreading out a lateral impact event over time is implemented, in one embodiment, by an external structure configured to receive the force from the lateral impact event and an assembly coupling the external structure to a helmet frame. The assembly is configured to extend or compress upon transfer of the force of the lateral impact event from the structure to the assembly.

The function of spreading out a direct impact event over time is implemented, in one embodiment, by an external structure attached to a helmet frame. The structure includes foam cells configured to compress upon receiving a direct impact.

The function of adding and removing protective cells from a helmet is implemented, in one embodiment, by a structure that includes a cell and a backplate. The backplate includes two vertical portions ending in hooks. A helmet frame includes a rectangular receiver dimensioned to receive the vertical portions and undercuts configured to capture the hooks.

The function of preventing a cell from rotating around its respective assembly is implemented, in one embodiment, by a receiver located in the assembly and a complementary shaped locking mechanism permanently coupled to the cell in a fixed position.

The function of reducing shearing stresses upon an assembly is implemented, in one embodiment, by positioning at least a portion of the assembly co-planar with the helmet frame and configuring the structure to move only in a tangential direction relative to the helmet frame.

Figure 11:
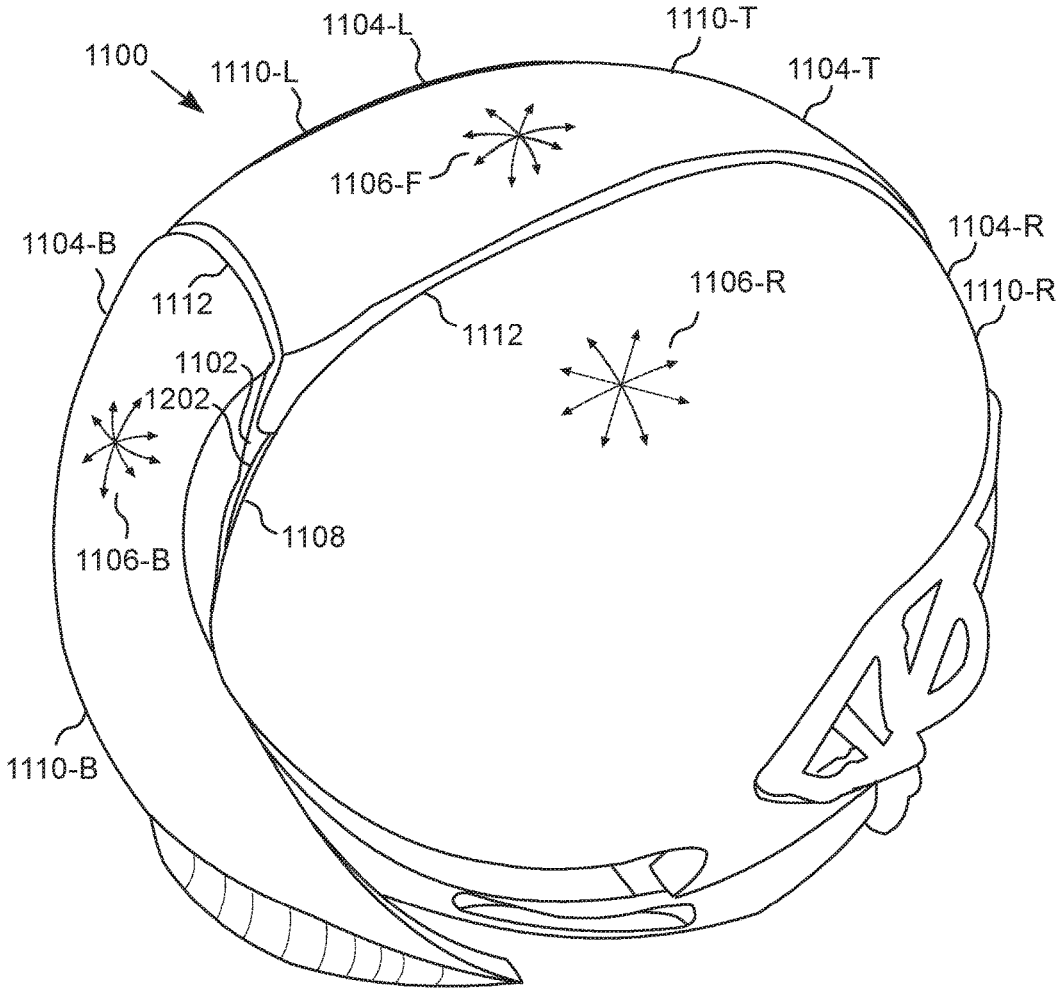
FIG. 11 is a rear top outside perspective view of another embodiment of a protective helmet.
Figure 12:
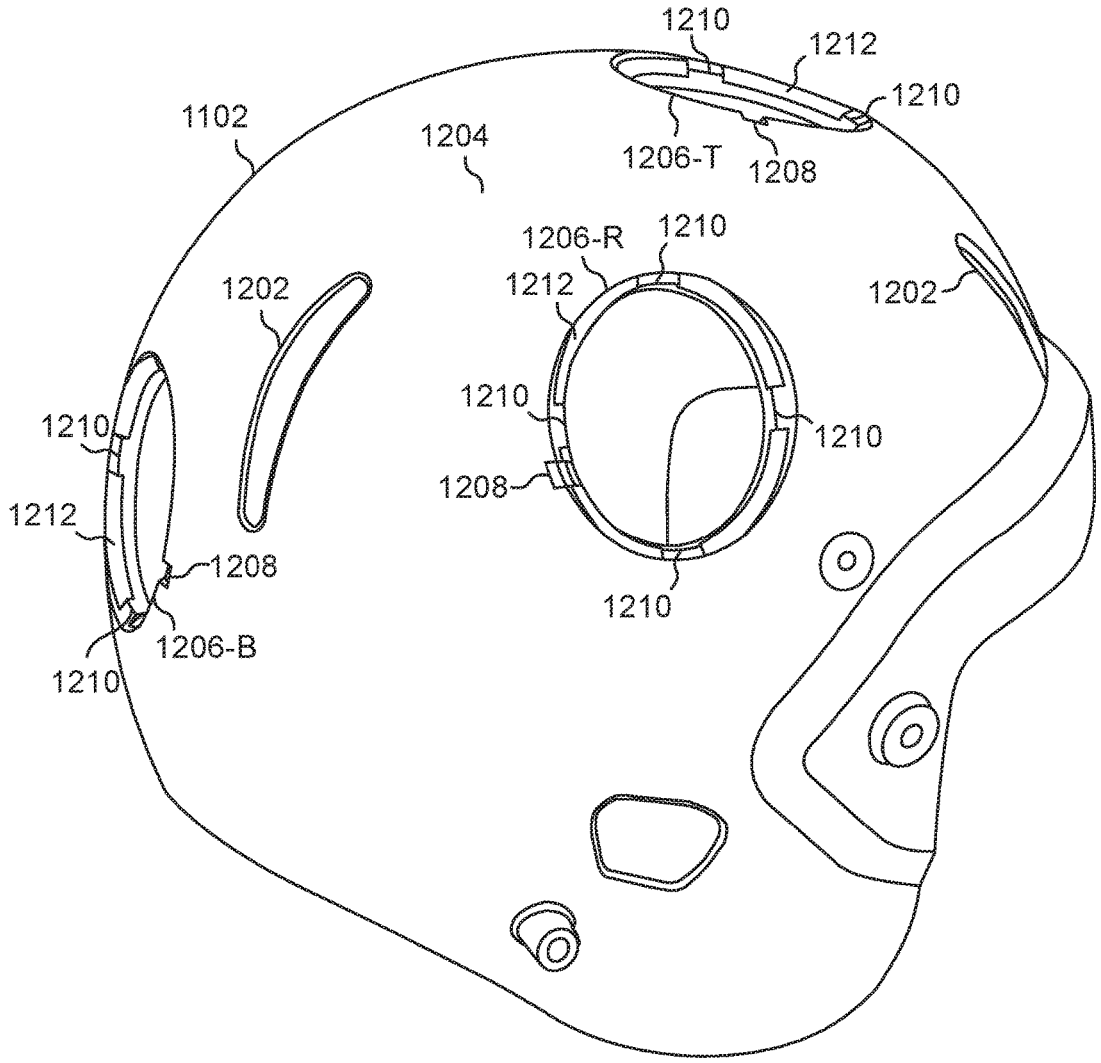
FIG. 12 is a side isometric view of a frame/shell of the embodiment of FIG. 11.

FIG. 11 illustrates a perspective view of another embodiment of the protective helmet 1100, and FIG. 12 illustrates an isometric view of an underlying frame 1102. The frame 1102 is a solid and rigid shell. The frame 1102 has an outer surface 1204. The frame outer surface 1204 is smooth and generally has a regular arcuate shape 2502.

Respective structures 1104-L, 1104-R, 1104-T, 1104-B are coupled to the frame 1102. The outer portion of the structures 1104 are respective cells 1110-L, 1104-R, 1104-T, 1104-B. The cells 1110 are resilient. The cells 1110 are made of foam. The cells 1110 are capable of deforming upon impact. After deforming from an impact, the cells 1110 bias to return to their original shape.

Each structure 1104 is capable of sliding tangentially on the shell outer surface 1204. Each respective structure 1104-L, 1104-R, 1104-T, 1104-B is capable of sliding in any direction 1106 on the shell outer surface 1204, although the magnitude of any direction 1106 is limited. Each respective structure 1104-L, 1104-R, 1104-T, 1104-B is capable of sliding independently of one another.

Structures 1104 have gaps 1112 between them to allow for greater freedom of sliding motion of the structures 1104. As shown in the gap 1112 between top structure 1104-T and back structure 1104-B, the adjacent faces of the structures 1104-T, 1104-B are essentially at supplementary angles to one another (supplementary in the sense of a spherical surface triangle in spherical geometry) to allow for more "give" against each other upon impact (see, e.g., FIG. 7, 708-B).

The structures 1104 shown in FIG. 11 are at their respective rest positions. If any structure 1104 in FIG. 11 is slid in any direction 1106 along the shell outer surface 1204, the structure 1104 will bias to return to its respective rest position.

The movement 1106 of the structures 1104 is generally limited to sliding tangentially along the arcuate shell outer surface 1204. When protecting a user from a head impact, the structures 1104 remain in direct contact with the shell outer surface 1204, that is, the structures 1104 do not lift away from the arcuate outer surface 1204 of the shell 1102. In addition, the structures 1104 have minimal twisting movement, such that upon being impacted by an outside force the tangential sliding motion 1106 of the structures will be more perceptible than any twisting of the structures 1104 relative to the shell outer surface 1204.

The shell 1102 includes vents 1202 for air to cool the user's head. The structures 1104 are positioned to create gaps 1108 such that the vents 1202 are not blocked from the outside when the structures 1104 are in their respective rest positions.

The shell 1102 is hard and rigid, and generally has a regular arcuate contour 2502 on the outside top, sides, and back. The shell 1102 includes openings 1206-T, 1206-R, 1206-L (not shown), 1206-B. The structure of the openings 1206 do not rise outside the shell outer surface 1204, such that the upper peripheries of the openings 1206 follow the regular contour of the shell outer surface 1204. Each opening 1206 is configured to receive a respective assembly 1802. The openings 1206 are essentially oval. Each opening 1206 is configured to receive the same size and shape of assembly 1802, thereby making the assemblies 1802 interchangeable. In other embodiments, the openings 1206 are different sizes or shapes.

The openings 1206 include four receivers 1210 for four assembly anchors 1712. Each anchor 1712 latches to its respective receivers 1210 once the assembly 1802 is pressed fully into the opening 1206. Each opening 1206 includes a groove 1208. The groove 1208 is configured to receive a prying instrument, for example, a flathead screwdriver. In order to mechanically detach and lift an assembly 1802 that has been fully placed into an opening 1206 (see FIG. 19), a user pries the assembly 1802 from the groove 1208 while simultaneously pressing in the retaining anchor 1712.

The elastomeric donuts 1302 have varying physical properties, including hardness, compressibility, resilience, Young's modulus, and so on. An assembly 1802 and its donut 1302 may be switched out for a different assembly 1802 with a donut 1302 that contains different physical properties.

Figure 13:
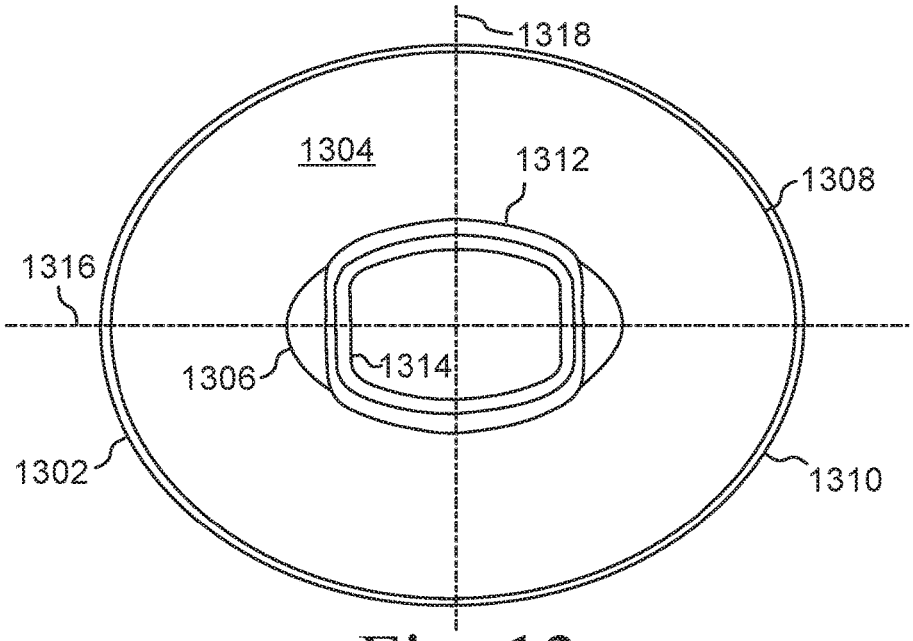
FIG. 13 is a top plan view of an another embodiment of a elastomeric donut.
Figure 14:
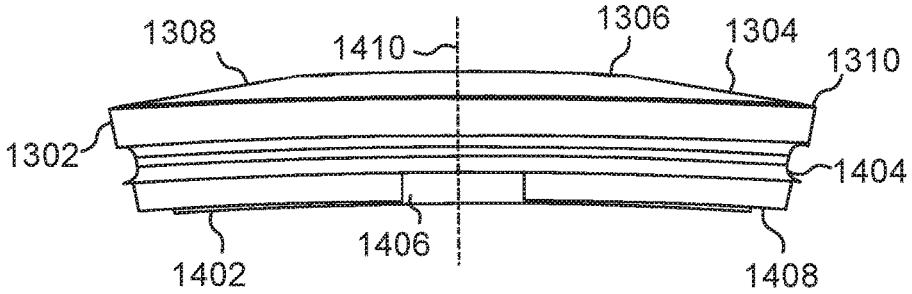
FIG. 14 is a side plan view of an embodiment of an elastomeric donut.

FIG. 13 illustrates a top plan view of a biasing mechanism 1302 that biases the structures 1104 to slide and return to their original rest positions. In the displayed embodiment, the biasing mechanism is a donut 1302. FIG. 14 illustrates a side plan view of the donut 1302.

The donut 1302 is resilient. The donut 1302 is elastic. The donut 1302 is elastomeric. The donut 1302 biases to return to its initial shape. Various embodiments of the donut 1302 have differing elasticity and compression characteristics.

The donut 1302 is elliptical from the top plan view. In other embodiments, the donut 1302 is circular from the top plan view. The donut 1302 has a major axis 1316. The donut 1302 has a minor axis 1318. The donut 1302 has a center axis 1410. The donut top surface 1304 is sloped. The upper top surface 1306 is at a steeper angle that the middle top surface 1308, which is at a steeper angle than the lower top surface (i.e., the periphery) 1310. The donut top surface 1304 is configured to essentially follow the general contour 2502 of the shell outer surface 1204 (see FIG. 25).

The donut 1302 includes an aperture 1312. The aperture 1312 is in the center of the donut 1302. The aperture 1312 is symmetrical from the top plan view. The aperture 1312 is centered in the donut top surface 1304. The aperture 1312 is centered in the donut bottom surface 1304. In other embodiments, the apertures 1312 is not centered in the donut 1302. The aperture 1312 extends from the donut top surface 1304 to the donut bottom surface 1402. The radius of the aperture 1312 at the donut top surface 1304 is greater (in all directions) than the radius of the aperture 1312 at the donut bottom surface 1402. The bottom of the aperture 1312 includes a rim 1314.

Figure 15:
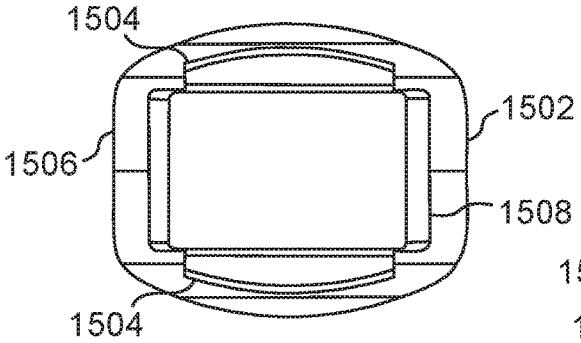
FIG. 15 is a top plan view of an embodiment of a hub.
Figure 16:
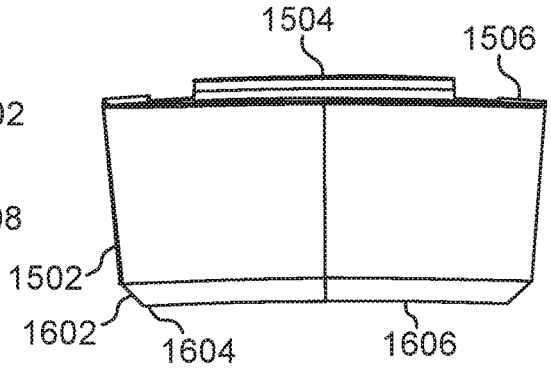
FIG. 16 is a side plan view of an embodiment of a hub.

The aperture 1312 is configured to receive a hub 1502. A top plan view of the hub 1502 is illustrated in FIG. 15. A side plan view of the hub 1502 is illustrated in FIG. 16. The aperture 1312 is shaped such that the hub 1502 fits snugly inside the aperture 1312, with direct contact between the donut 1302 and the outside of the hub 1502. The hub 1502 includes rests 1602, which are beveled and which fit against the rim 1312 of the donut 1302. The hub bottom surface 1606 includes lips 1604 that are extend further inward than the donut rim 1314 and therefore are exposed in the donut aperture 1312 from donut bottom 1402 when the hub 1312 is fully inserted into the donut aperture 1312.

The hub 1502 includes protrusions 1504. The protrusions 1504 extend from the hub top surface 1506. The remainder of the top surface 1506 slopes downward from the center. The hub 1502 includes a hole 1508 in the center that extends from the top surface 1506 and slopes inward on two opposing sides to the bottom surface 1606. The hub 1502 is rigid and solid.

Figure 17:
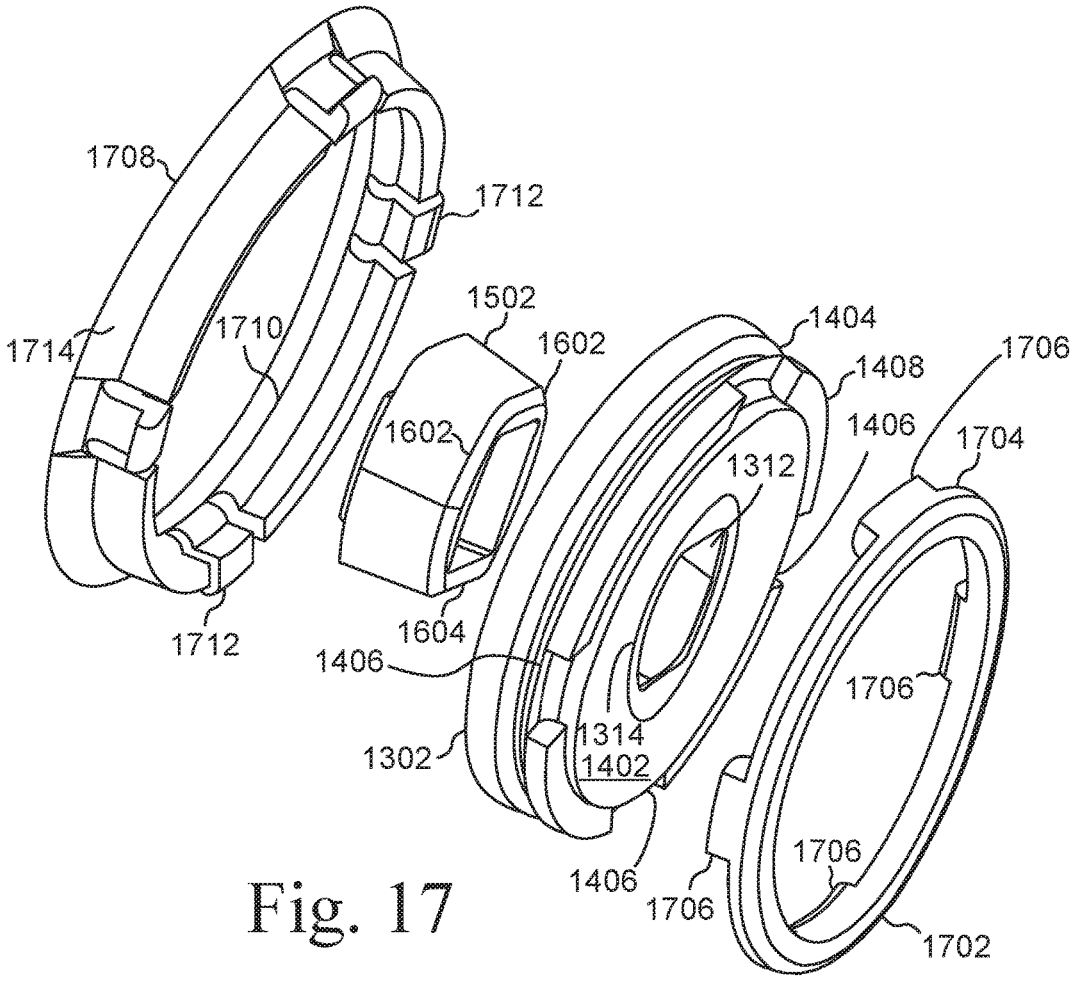
FIG. 17 is an exploded view of an embodiment of an assembly.
Figure 18:
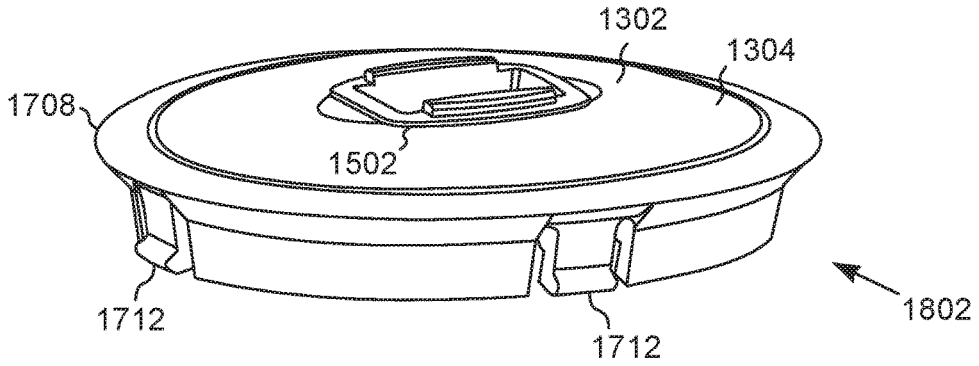
FIG. 18 is a top isometric view of an embodiment of an assembly.

FIG. 17 illustrates an exploded view of an assembly 1802, and FIG. 18 illustrates a top isometric view of the assembly 1802. The assembly 1802 includes the donut 1302, the hub 1502, a snap ring 1708, and a outer support ring 1702. The assembly 1802 components are chemically bonded to one another. The assembly 1802 components bias to a single rest position relative to one another.

The snap ring 1708 is configured to receive and encircle the donut 1302. The snap ring 1708 is rigid and made of a hard material, such as hard plastic. The snap ring includes a bulge 1710 that fits inside the channel 1404 of the donut 1302.

The snap ring 1708 includes two pairs of opposing anchors 1712. The anchors 1712 are slightly bendable inward and bias to return to their rest position. When placing the assembly 1802 in the shell opening 1206, the anchors 1712 are configured to be pressed past the assembly receivers 1210 and latch against the bottom surface ring 2004. The upper outer side 1714 of the snap ring 1708 slopes inward and is configured to rest on the shelf 1212 of the shell opening 1206.

The outer support ring 1702 encircles the bottom portion of the donut 1302. The outer support ring 1702 includes a ridge 1704 that is configured to fit inside a corresponding receiver 1408 that the bottom of the donut 1302. Extending from the ridge 1704 are teeth 1706 that are configured to fit snugly inside alcoves 1406. In one embodiment, the outer support ring 1706 is hard and rigid.

With the exception of the hub 1502, the top of the assembly 1802 follows the regular contour 2502 of the shell outer surface 1204.

Figure 19:
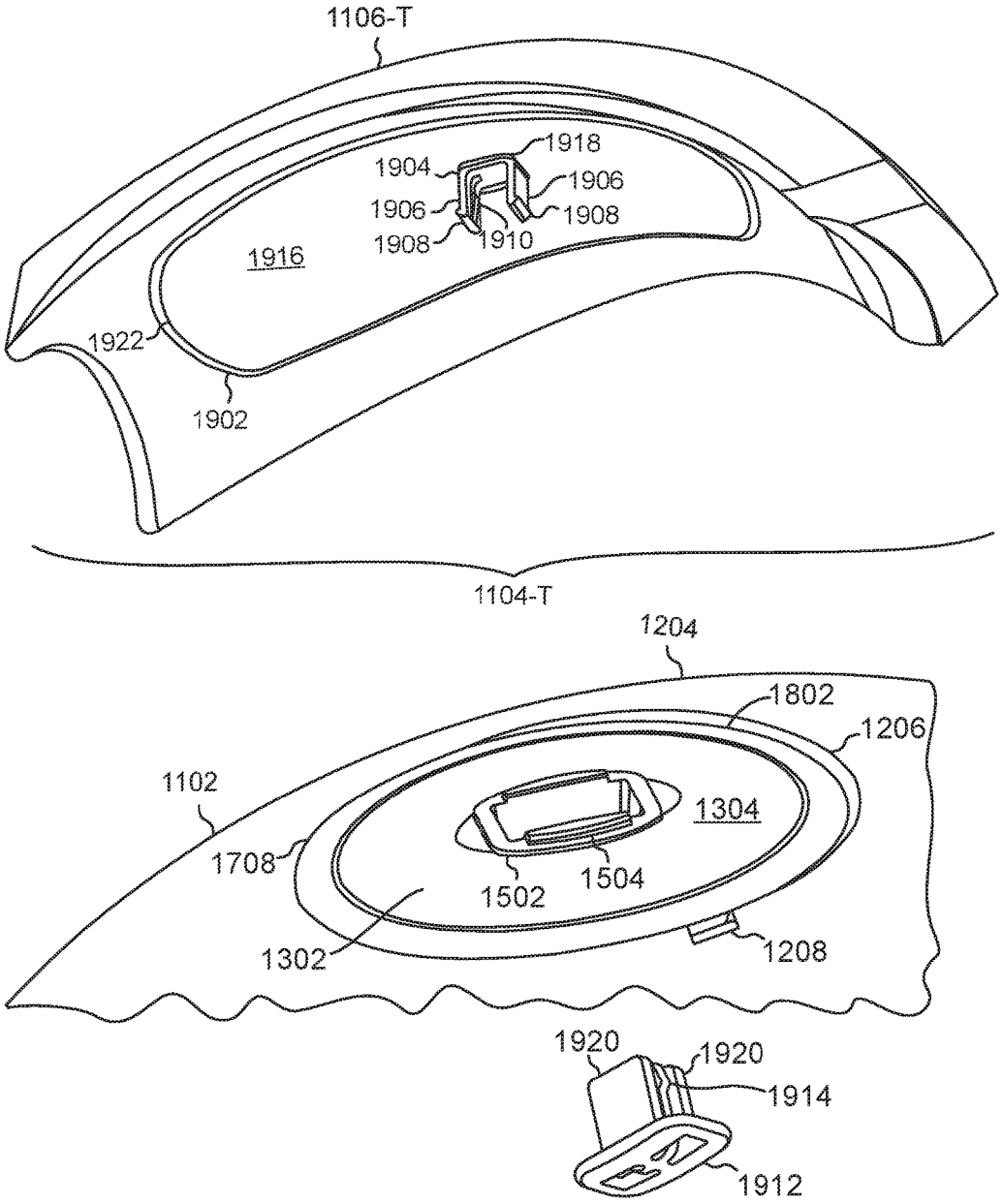
FIG. 19 is a side isometric view of an embodiment of a structure, assembly inserted into a shell opening, and retaining clip.

FIG. 19 illustrates a top structure 1104-T, the assembly 1802 attached inside the shell hole 1206, and a retaining clip 1912. The top structure 1104 includes the cell 1106-T and a corresponding backplate 1902. The cell 1106-T and backplate 1902 are chemically bonded. The backplate is made of a material that is hard and rigid, for example, hard plastic. The backplate 1902 has a bottom surface 1916. The backplate bottom surface 1916 has a periphery 1922. Within the bottom surface periphery 1922 is a fastener 1904. The fastener 1902 includes two prongs 1906 that extend essentially perpendicular from the general contour of the bottom surface 1916. At the distal end of each prong 1906 is a hook 1908. On the inside of the each prong 1906 is a protrusion 1910.

With the exception of the fastener 1902 and recesses 1918, the backplate bottom surface 1916 essentially follows the regular contour 2502 of the shell outer surface 1204. Likewise, the structure 1104 bottom surface essentially follow the regular contour 2502 of the shell outer surface 1204.

When coupling the structure 1104-T to the shell 1102, the prongs 1904 are pushed into the top of hub hole 1508 such that the prongs 1904 extend past the hub bottom surface 1606. The hooks 1908 press up against the hub bottom surface 1606 at the lip 1064.

Figure 24:
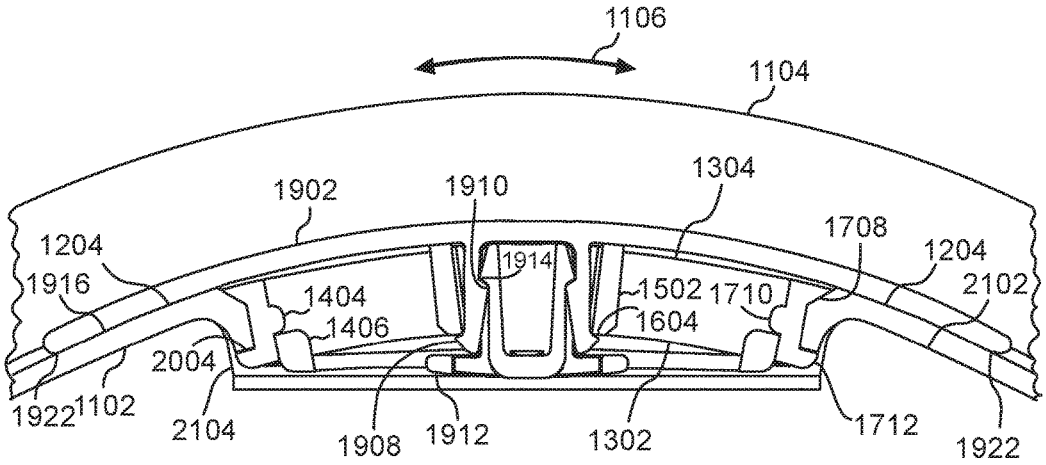
FIG. 24 is a cross-section of a portion of an embodiment of a helmet.

A retaining clip 1912 assists in securing the structure 1104-T to the assembly 1802. The retaining clip 1912 is inserted up through the bottom of the hub hole 1508. The clip 1912 includes counter-protrusions 1914. As shown in FIG. 24, the counter-protrusions 1914 lock and press against the fastener protrusions 1910, thereby pressing the fastener prongs 1906 outward and securing the hooks 1908 to prevent the hooks 1908 from pressing inward and slipping off the bottom surface of the lip 1064. The clip includes side walls 1920 that form opposing side walls of a box with prongs 1906 when the clip 1912 and prongs 1904 are joined together.

Hub projections 1504 lodge in recesses 1918 in the backplate bottom surface 1916 immediately adjacent the fastener 1904, which assists in preventing the hub 1502 from rotating relative to the backplate 1902.

Figure 20:
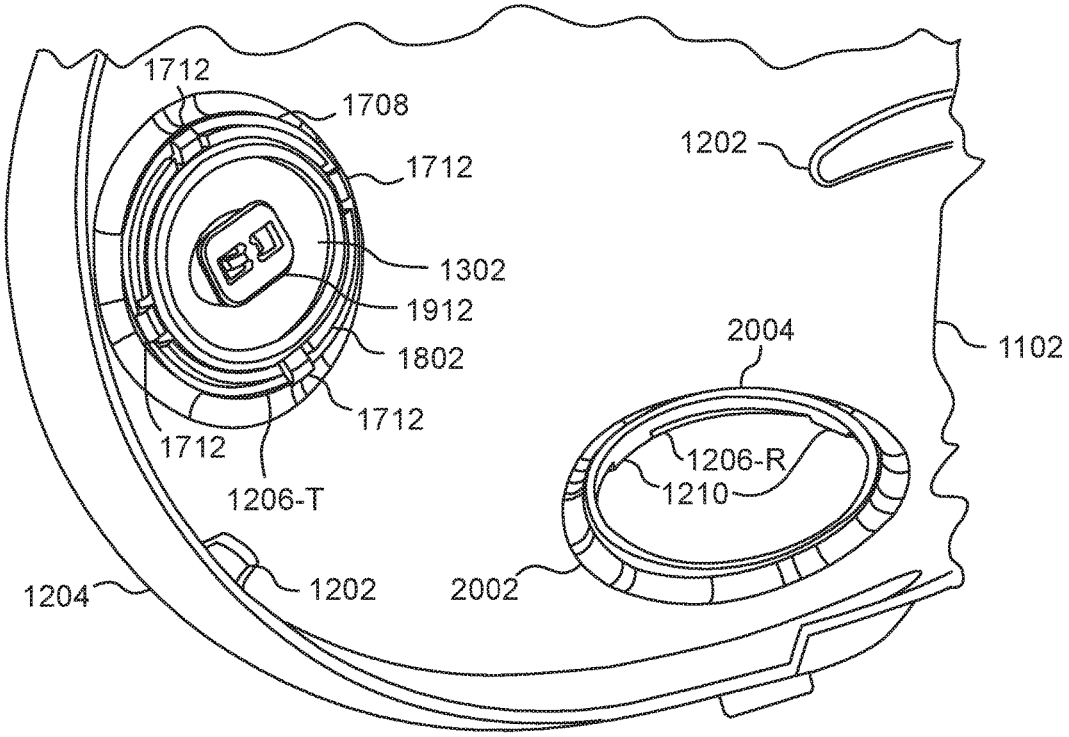
FIG. 20 is an inside view of a portion of an embodiment of a shell.

FIG. 20 illustrates an inside view of a portion of the shell 1102. Two shell openings 1204 are shown, namely, the top opening 1206-T and the right opening 1206-R. The top opening 1206-T has an assembly 1802, clip 1912, and structure (not shown) fully attached together. The right opening 1206-R is empty.

Each opening 1206 has an undersurface 2002 that extends upward in a concave curve. The undersurface 2002 distal end is a horizontal plateau in the shape of a ring 2004. Both the snap ring 1708 and the outer support ring 1702 extend past the opening ring 2004. Anchors 1712 from the assembly 1802 press and hold against the ring 2004, thereby keeping the assembly 1802 inside the opening 1206.

In order to detach an assembly 1802 from the shell 1102, the clip is pulled out from the underside of the shell 1102. The prongs 1906 are pressed inward and the structure 1104 is pulled off the shell outer surface 1204. A prying device (e.g., the tip of a flathead screwdriver), is lodged into groove 1208 on the outer surface 1204 and levered upward against the snap ring 1708. Anchors 1712 are pressed inward against the donut 1302 until the anchors are pulled past the ring 2004.

Figure 21:
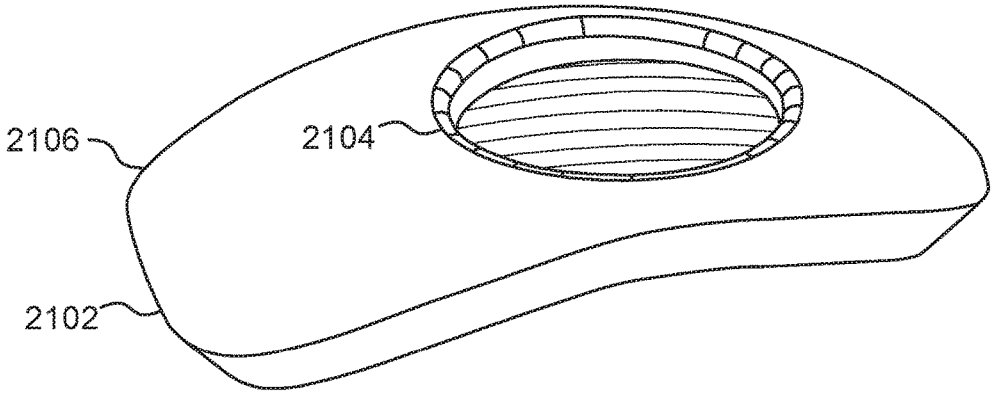
FIG. 21 is a top isometric view of an embodiment of an inner pad.
Figure 22:
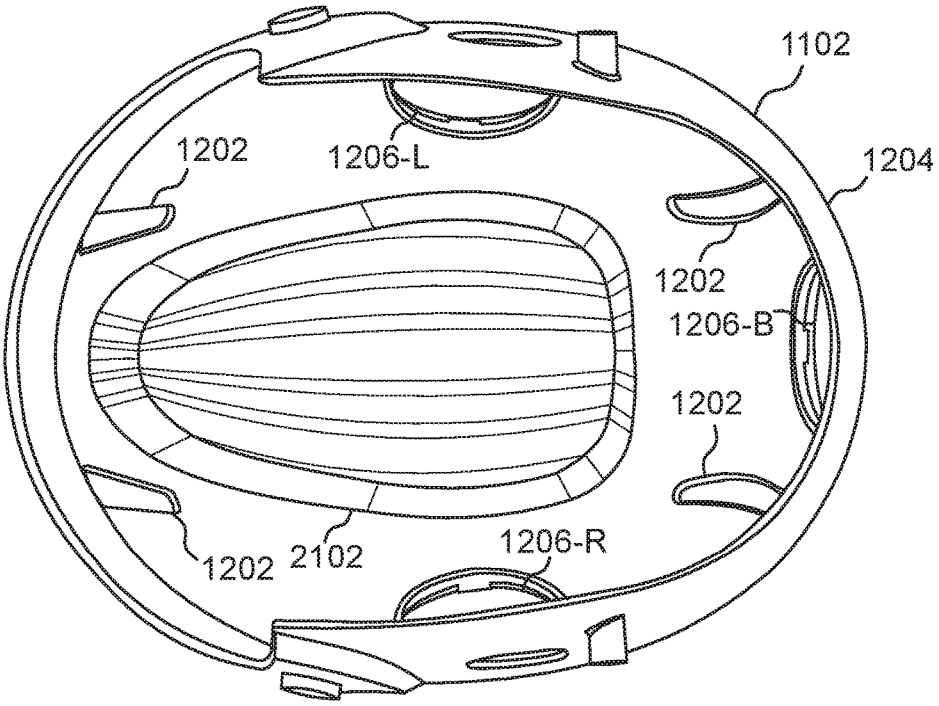
FIG. 22 is a bottom isometric view of an embodiment of a helmet with an attached inner pad.

FIG. 21 illustrates an inner pad 2102. The inner pad 2102 is resilient. In one embodiment, the inner pad 2102 is made of foam. The inner pad 2102 includes a recess 2104 configured to receive an opening undersurface 2002 with a fully inserted assembly 1802. The top surface 2106 is configured to fit flush with and frictionally fit on the inside surface of the shell 1102. FIG. 22 displays an inside view of the shell 1102, with one of the pads 2102 properly placed. When the helmet 1100 is completely equipped, the recess 2104 of a corresponding pad 2102 is frictionally fitted on each undersurface 2002 and attached assembly 1802.

Figure 23:
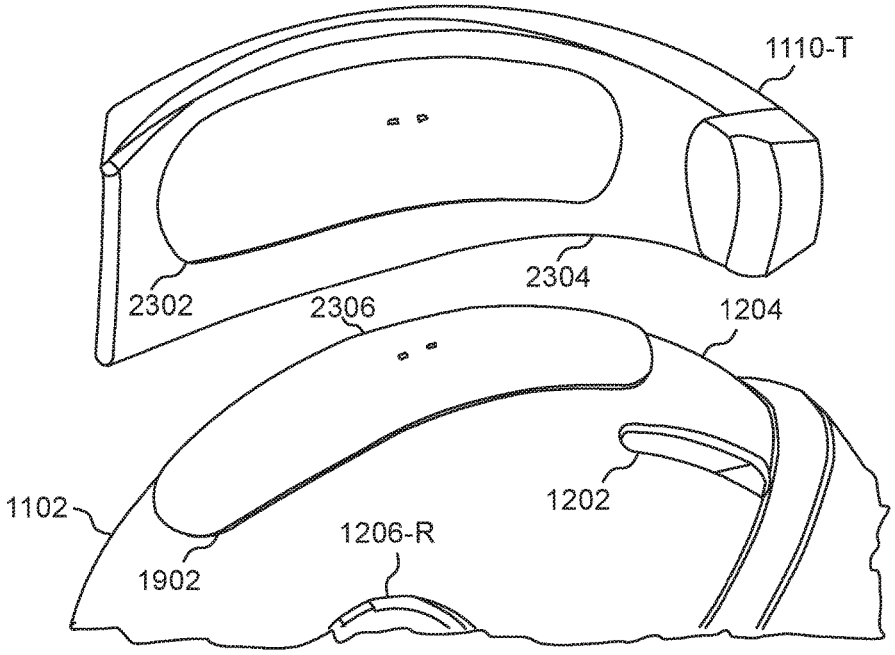
FIG. 23 is a side isometric view of a cell detached from a backplate, which is coupled to a shell.

FIG. 23 illustrates a cell 1110-T detached from a backplate 1902, which in turn is mechanically attached to an assembly 1802 (not shown) and coupled to the outer surface 1204 of the shell 1102. The separation of parts shown in FIG. 23 would not normally occur in everyday use, because the cell 1110-T is ordinarily chemically bonded to the backplate 1902, and the cell 1110 and corresponding backplate 1902 are attached to and detached from the shell 1102 as a single unit.

Cell 1110-T includes a recess 2302 on the inner surface 2304. The recess 2302 is shaped to receive and be flush with the backplate top surface 2306. However, as shown in FIG. 24, the backplate bottom surface 1916 extends beyond the cell recess 2302. As a result, at the backplate periphery 1922, the cell bottom surface 2304 immediately surrounding the recess 2302 is directly adjacent to, but does not contact, the shell outer surface 1204.

FIG. 24 illustrates a cross-section of a portion of the helmet 1100. The structure 1104 is able to slide tangentially 1106 on the shell outer surface 1204. The magnitude of a slide is dependent upon the compression and elastic properties of the donut 1302. The theoretical limit of the magnitude of the slide displacement is limited to the distance between the hub 1502 and the snap ring 1708. The backplate 1902 is configured to be of sufficient width such that the backplate underside periphery 1922 does not slide directly over the top surface 1304 of the donut 1302.

Figure 25:
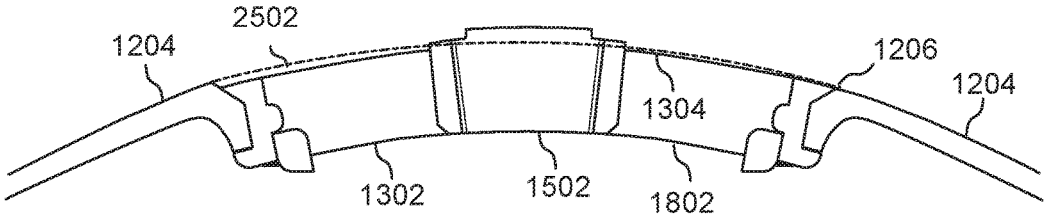
FIG. 25 is cross-section of an embodiment of a shell with an inserted assembly.

FIG. 25 illustrates an assembly 1802 inserted into a shell opening 1206. The elastomer top surface 1304 essentially follows the regular arcuate contour 2052 of the shell outer surface 1204.

Figure 26:
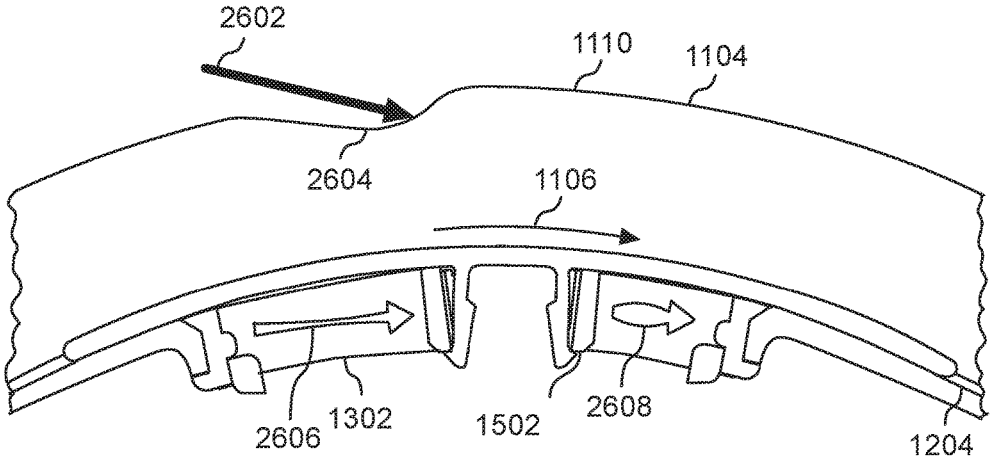
FIG. 26 is an illustration of an external impact on a cross-section of selected components in an embodiment.

FIG. 26 is a simplified illustration of the helmet 1100 mitigating the effects of a external mostly tangential impact 2602 before the impact 2602 reaches the user's head.

The impact 2602 creates a distortion 2064 in the cell 1104. Some of the energy from the impact 2602 is expended to create the cell distortion 2064. Some of the impact energy is converted to heat energy expended to change the shape of the cell 1104 and create the distortion 2064, and some of the energy from the impact 2602 is converted to potential energy stored in the compression of the cell 1104, which is released as the resilient cell 1104 returns to its original shape.

Some of the energy from the impact 2064 is absorbed in the form of potential energy stored in the distortion 2606, 2608 of the donut 1302. The impact 2602 causes the structure 1110 to slide tangentially 1106 over the shell outer surface 1204. Some of the impact energy 2064 is dissipated as heat to the extent that any friction exists between the sliding backplate 1902 the shell outer surface 1204. The hub 1502 is pushed to the right by the attached structure 1104, thereby distorting the donut 1302. A portion of the donut 1302 is stretched 2606, and a portion of the donut 1302 is compressed 2608. Both the stretching 2606 and compression 2608 convert energy from the impact 2602 into spring-type potential energy stored in the donut 1302. Some energy from the impact 2602 is also converted into heat energy during the process of altering the shape of the donut 1302.

Figure 27:
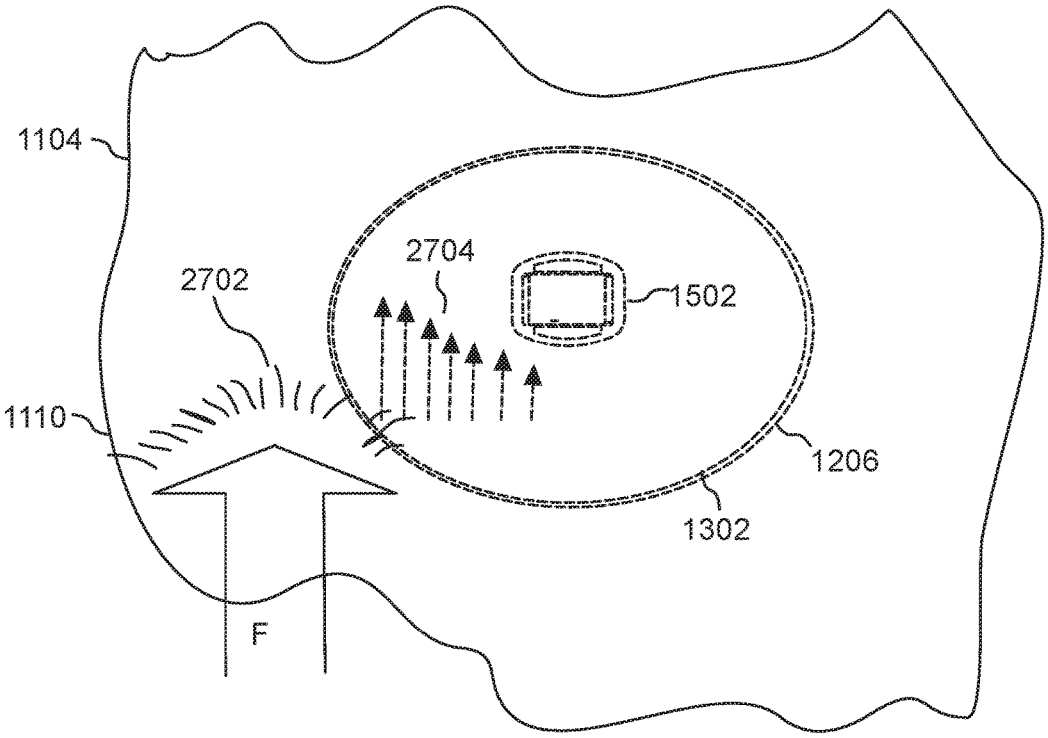
FIG. 27 is an illustration of an external impact on a cell that is part of a structure coupled to a protective helmet.

As illustrated in FIG. 27, an actual impact on the cell 1110 of a structure 1104 will be dispersed over a wide area 2702 due to the deformation of the cell 1110. As shown in FIG. 12, the shell openings 1206 are configured for elastomers 1302 that are wide and strategically placed, such that the majority of likely hits on the helmet 1100 will at least partially pass over the elastomer 1302 and transfer at least a portion of the impact 2704 into compressing/extending the donut 1302. In some instances, the donut 1302 will be subject to twisting or torquing about its central axis 1410.

Figure 28:
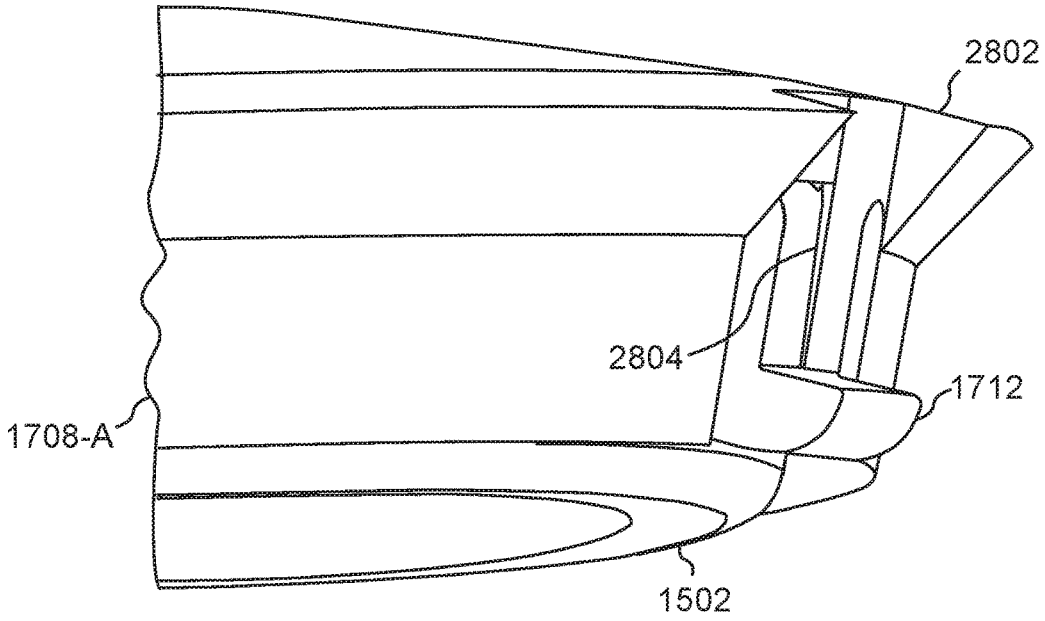
FIG. 28 is a side isometric view of another embodiment of a snap ring in an assembly.
Figure 29:
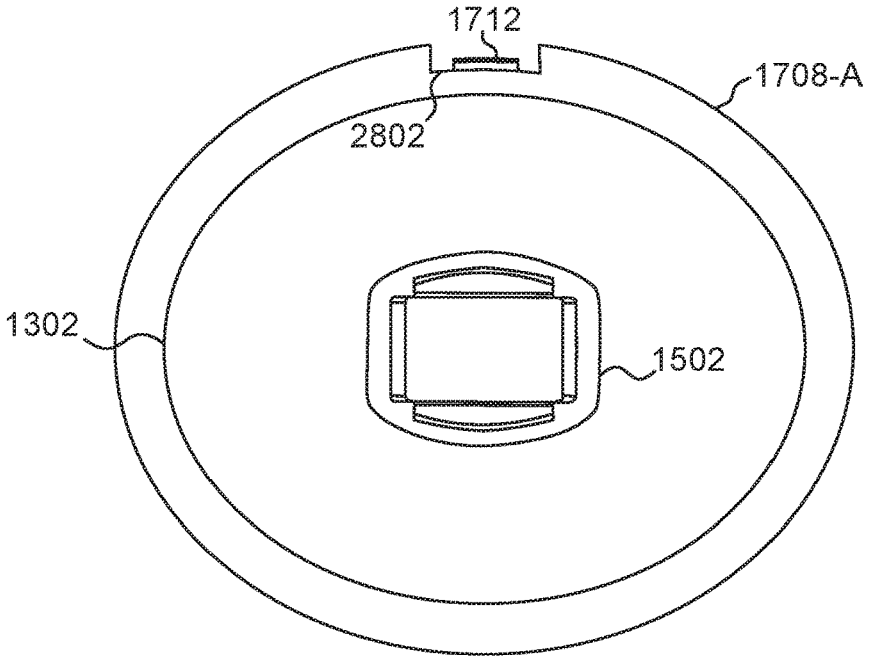
FIG. 29 is a top plan view of the snap ring embodiment of FIG. 28.

FIGS. 28 and 29 illustrate another snap ring embodiment 1708-A in an assembly 1802. The snap ring 1708-A includes a pry slot 2802 allowing access to the anchor 1712. In other embodiments, there are a plurality of pry slots 2802 allowing access to a plurality of respective anchors 1712. The slot 2802 is in the snap ring top surface and allows a user to pry the anchor 1712 inwards so that it no longer attaches to the bottom surface ring 2004. In this embodiment 1708-A, the middle of the exposed anchor 1712 includes setback 2804 in order to allow a prying object, e.g., a flathead screwdriver, to rest against the setback 2804 during the prying process. In one embodiment, the pry slot 2802 is an adequate functional replacement for the groove 1208 on the shell outer surface 1204.

While the present invention has been illustrated by description of embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for protecting a user from an impact, said apparatus comprising:

a shell configured to receive a human head, said shell has an outer surface, a plurality of structures, wherein each structure of said plurality of structures includes (a) an attachment mechanism coupling said structure to said shell, (b) a bottom surface that includes an area in direct contact with said shell outer surface, said area includes a periphery, and (c) a location inside said periphery at which said attachment mechanism is affixed to said bottom surface, wherein said periphery is configured to slide tangentially on said outer surface of said shell when the impact impacts on said structure, and wherein said periphery is configured to slide from a first position to a second position on said shell outer surface wherein each said structure has an assembly corresponding to said structure, said assembly is coupled to said shell is configured to receive said attachment mechanism such that said structure is coupled to said shell by said assembly, and includes a biasing mechanism that biases said periphery to return to said first position after the impact.

2. The apparatus of claim 1, wherein each said structure is mechanically detachable from said shell and mechanically re-attachable to said shell.

3. The apparatus of claim 1, wherein each said biasing mechanism is an elastomeric donut.

4. The apparatus of claim 3, wherein each said elastomeric donut includes a top surface, wherein sliding magnitude of said periphery is limited such that said periphery cannot slide over said top surface of said donut.

5. The apparatus of claim 4, said outer surface of shell has a contour, said contour is regular and arcuate, said top surface substantially follows said contour.

6. An apparatus for protecting a user from an impact, said apparatus comprising:

a shell that fits a human head, said shell has an outer surface, a plurality of structures, each structure is independently coupled to said shell, each said structure includes (a) a backplate that is rigid, said backplate includes a contact area that is direct contact with said outer surface, said contact area is configured to slide tangentially along said outer surface from a first position to a second position upon the impact upon said structure, and (b) a cell affixed to said backplate, said cell is configured to deform from a first shape to a second shape upon the impact on said cell, said cell biases to re- forming to said first shape, wherein each said structure is coupled to a corresponding biasing mechanism, said biasing mechanism biases said contact area to return to said first position after the impact.

7. The apparatus of claim 6, wherein each said structure further includes:

(c) an attachment mechanism coupling said structure to said shell, said contact area has a periphery, said attachment mechanism is a part of said backplate and is positioned inside said periphery.

8. The apparatus of claim 6, wherein each said biasing mechanism is an elastomeric donut located in a respective opening, each said opening is on said outer surface.

9. The apparatus of claim 8, each said elastomeric donut has a center that is open, wherein a hub is affixed to said elastomeric donut in said center, said attachment mechanism latches to said hub.

10. The apparatus of claim 8, each said elastomeric donut is mechanically detachable from said shell and mechanically re-attachable to said shell.

11. The apparatus of claim 8, wherein essentially all of each said elastomeric donut is inside said opening on said outer surface.

12. The apparatus of claim 6, each said structure is mechanically detachable and mechanically re-attachable to said shell.

13. A helmet for protecting a user from an impact, said helmet comprising:

a shell configured to receive a human head, said shell has an outer surface, a plurality of structures coupled to said shell, each structure is in direct contact with said outer surface of said shell, each said structure is configured to slide tangentially on said outer surface independently from one another, each said structure is configured to slide tangentially on said outer surface of said shell from a respective first position to a respective second position, each said structure biases to slide and return to said respective first position upon the impact, each said structure includes a respective cell, each said respective cell is configured to deform from a respective first shape to a respective second shape, each said respective cell biases to return to said respective first shape from the respective second shape after the impact occurs;

each said structure is coupled to a respective elastomeric donut, each said respective donut is located inside a respective opening, each said respective opening is on said outer surface of said shell.

14. The helmet of claim 13, each said structure is mechanically detachable from said shell and mechanically re-attachable to said shell.

* * * * *